US011554913B2

(12) United States Patent
Sedory et al.

(10) Patent No.: US 11,554,913 B2
(45) **Date of Patent: *Jan. 17, 2023**

(54) REFUSE CONTAINER HAVING INDICATOR ASSEMBLY

(71) Applicant: Wastequip LLC, Charlotte, NC (US)

(72) Inventors: Richard Sedory, Charlotte, NC (US); Martin Damon Bryant, Charlotte, NC (US); Kristin Kinder, Seattle, WA (US); Jennifer Coates, Charlotte, NC (US); Tyler Brown, Charlotte, NC (US)

(73) Assignee: Wastequip LLC, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/379,797

(22) Filed: Jul. 19, 2021

(65) Prior Publication Data

US 2021/0347566 A1 Nov. 11, 2021

Related U.S. Application Data

(63) Continuation of application No. 16/745,702, filed on Jan. 17, 2020, now Pat. No. 11,066,236.
(Continued)

(51) Int. Cl.
*B65F 1/14* (2006.01)
*B65F 1/02* (2006.01)
*B65F 1/16* (2006.01)

(52) U.S. Cl.
CPC ..... *B65F 1/1484* (2013.01); *B65F 1/02* (2013.01); *B65F 1/1646* (2013.01);
(Continued)

(58) Field of Classification Search
None
See application file for complete search history.

(56) References Cited

U.S. PATENT DOCUMENTS 1,255,909 A * 2/1918 Monasch ..... G09F 11/23 40/907
3,748,767 A * 7/1973 Giesecke ..... G09F 7/00 40/907

(Continued)

OTHER PUBLICATIONS

Swedberg, Claire, "Toter Dumps Wasted Time With RFID-Tagged Bins," RFID Journal, Jun. 29, 2016, available at http://www.rfidjournal.com/articles/view?14676 (last accessed Mar. 21, 2022).

*Primary Examiner* — John F Mortell
(74) *Attorney, Agent, or Firm* — Nelson Mullins Riley & Scarborough LLP

(57) ABSTRACT

A refuse container having an indicator assembly for informing a waste generator of contamination in a waste stream. A refuse container includes a container body comprising a receptacle portion and a lid coupled with the receptacle portion. The receptacle portion includes a plurality of walls that together define an enclosed space for containing refuse. An indicator device is coupled with the container body. The indicator device is movable relative to the container body between a first position and a second position. First indicia is provided on one of the indicator device or the container body. When the indicator device is in the first position, the first indicia are visible from the exterior of the refuse container, and when the indicator device is in the second position, the first indicia are not visible from the exterior of the refuse container.

17 Claims, 8 Drawing Sheets

Related U.S. Application Data

(60) Provisional application No. 62/794,569, filed on Jan. 19, 2019.

(52) U.S. Cl.
CPC ... *B65F 2210/128* (2013.01); *B65F 2210/138* (2013.01); *B65F 2210/152* (2013.01)

(56) References Cited

U.S. PATENT DOCUMENTS 4,912,687 A 3/1990 Treeby
5,261,562 A * 11/1993 Prout ..... B65F 1/1607 220/908
5,358,582 A * 10/1994 Koshizuka ..... B42D 25/23 156/235
8,056,817 B2 11/2011 Flood
8,146,798 B2 4/2012 Flood et al.
8,185,277 B2 5/2012 Flood et al.
8,210,428 B2 7/2012 Flood
8,714,440 B2 5/2014 Flood et al.
9,251,388 B2 2/2016 Flood
9,546,040 B2 1/2017 Flood et al.
10,035,647 B1 7/2018 Rodoni
2003/0146221 A1* 8/2003 Lauer ..... B65F 1/06 220/495.01
2007/0262878 A1 11/2007 Maruca et al.
2007/0267831 A1* 11/2007 Sheehan ..... B65F 1/1468 280/47.34
2007/0268759 A1 11/2007 Sabino et al.
2008/0222929 A1* 9/2008 Sawin ..... A47K 10/421 221/45
2012/0006838 A1 1/2012 Michael et al.
2014/0239059 A1 8/2014 Flood et al.
2014/0278630 A1 9/2014 Gates et al.
2014/0299619 A1 10/2014 Foster
2014/0379588 A1 12/2014 Gates et al.
2015/0199446 A1 7/2015 Flood
2016/0239689 A1 8/2016 Flood
2017/0022005 A1 1/2017 Foster
2017/0022006 A1 1/2017 Foster
2018/0153389 A1* 6/2018 Dixon ..... A61B 1/267
2019/0197498 A1 6/2019 Gates et al.
2020/0013024 A1 1/2020 Armstrong et al.
2020/0193620 A1 6/2020 Armstrong et al.

* cited by examiner

REFUSE CONTAINER HAVING INDICATOR ASSEMBLY

PRIORITY CLAIM

This application is a continuation under 35 U.S.C. § 120 of co-pending U.S. application Ser. No. 16/745,702, filed Jan. 17, 2020, which claims the benefit under 35 U.S.C. § 119(e) of U.S. Provisional Application Ser. No. 62/794,569, entitled "Refuse Container Having Indicator Assembly," filed on Jan. 19, 2019, each of which are hereby relied upon and incorporated by reference herein for all purposes.

TECHNICAL FIELD

Embodiments of the present invention generally relate to the collection of refuse, including garbage, trash, and/or recyclable materials. More particularly, certain embodiments of the present invention relate to systems and methods for signifying non-compliance with rules designed to eliminate contamination in a waste stream. In some specific embodiments, a waste generator who deposits waste in a container may be informed that waste stream contaminants are present in the container via an indicator assembly associated with the container.

BACKGROUND

Various containers are used for the storage, collection, and transport of various types of refuse, including household garbage and recyclable materials. For example, FIG. 1 illustrates a typical wheeled "roll out" container 10 which includes a body 20 and a lid 30. Lid 30 is attached to body 20 with a plurality of hinges. Wheels 40 are coupled with body 20. Customers, such as residences and businesses, may use containers like container 10 to store refuse. Municipalities and/or private companies may collect such refuse from customers on a periodic basis, as is well understood.

In some cases, container 10 may be designated for use with a single type of refuse, such as recyclable materials. Such "single-stream" programs have become more common in the United States in the past decade. Unfortunately, waste generators commonly fail to comply with rules regarding materials that should and should not be included in a designated single-stream refuse container, thereby introducing contaminants into the designated waste stream. Typically, a waste generator will include some permissible materials and some non-permissible materials, such that the allowed and prohibited refuse is commingled in the designated container. And despite such contamination, municipalities typically will still collect these commingled materials. Indeed, enforcing low-contamination is challenging for these municipalities and companies, because most cities cannot depend on drivers to check inside every container and because paying inspectors to police container use is prohibitively expensive.

Limiting contamination in waste streams is important to participants in the waste and recycling industries, such as municipal and/or private company waste haulers and materials recovery facilities (also known as materials reclamation facilities, materials recycling facilities, and multi re-use facilities, collectively, "MRFs"), at least because of increased costs and/or lost revenue from processing and/or selling contaminated waste streams. Current trends in the industry highlight some of the problems contaminated waste streams pose. Taking the recycling waste stream as an example, packaging (which comprises much of recycling) has evolved considerably, so materials available to recycle are constantly changing. Also, as noted above, single-stream recycling programs have increased in popularity, such that 65% of MRFs in the United States are now single-stream, whereas only 27% were in 2006. Single-stream recycling programs typically bring in more contamination, as much as 25% by one estimate. Where, for example, one of every four tons of the material coming into single-stream MRFs is not marketable, this greatly decreases revenue and increases costs for processing the waste stream through machinery at the MRF. Moreover, China receives approximately one-third of all recyclables from the United States (approximately 22 million tons annually). However, China's 2017 "National Sword" policy requires that contamination in imported recyclables be below 0.5% per bale, and China plans to ban all imports of recyclables by 2020. Thus, MRFs can be stuck with material they cannot sell, and they must slow down operations to meet acceptable contamination levels, all of which adds to processing costs.

Prior art attempts to address these issues have been unsatisfactory. One example of such an attempt is illustrated in FIG. 2, which is a detail perspective view of a refuse container 50 with a removable tag 60 attached to a handle 70 thereof. In particular, a municipal or private company hauler may attach such a tag 60 to handle 70 when the hauler identifies contaminants deposited in container 50. The hauler may also decline to collect the refuse in container 50 as a result. Tag 60, colloquially known as an "oops" tag, contains information regarding potential contaminants that may be deposited in container 50. For instance, tag 60 may instruct the user not to put specific types of non-recyclable materials in container 50 and/or it may indicate for the user the specific type of contamination (e.g., plastic bags, Styrofoam, linens) found in container 50. Tag 60 may also be used to inform the user of container 50 of other violations, such as with respect to improper placement of the container for collection or any additional reason that the refuse in container 50 could not be collected.

However, tags 60 are inefficient for haulers to use. They can be difficult to attach to a container 50 in general, and particularly in a manner in which tags 60 may be noticeable to residential customers. Also, tags 60 can be easily separated or tear away from container 50, and they cannot withstand the harsh elements and operational rigors to which container 50 may be subject. Further, tags 60 may not provide meaningful feedback to waste generators, and they cannot be used to efficiently track compliance or non-compliance by waste generators. For at least these reasons, tags 60 have been ineffective at impacting waste generator behavior.

SUMMARY

In accordance with one embodiment, a refuse container comprises a container body comprising a receptacle portion and a lid coupled with the receptacle portion. The receptacle portion comprises a plurality of walls that together define an enclosed space for containing refuse. An indicator device is coupled with the container body. The indicator device is movable relative to the container body between a first position and a second position. First indicia is provided on one of the indicator device or the container body. When the indicator device is in the first position, the first indicia are visible from the exterior of the refuse container, and when the indicator device is in the second position, the first indicia are not visible from the exterior of the refuse container.

In accordance with another embodiment, a system comprises an indicator assembly coupled with a refuse container. The indicator assembly comprises processing circuitry comprising a memory and at least one indicator device in communication with the processing circuitry. The at least one indicator device is movable relative to the refuse container between a first position and a second position. The processing circuitry is programmed to store information regarding the contents of the refuse container in the memory in response to movement of the indicator device from the first position to the second position.

In yet another embodiment, a system comprises an indicator assembly coupled with a refuse container. The indicator assembly comprises at least one transponder operative to wirelessly communicate with interrogator electronics via radio frequency signals and at least one indicator device. The at least one indicator device is movable relative to the refuse container between a first position and a second position. First indicia is provided on one of the at least one indicator device or the refuse container. When the at least one indicator device is in the first position, the first indicia are visible from the exterior of the refuse container, and when the at least one indicator device is in the second position, the first indicia is not visible from the exterior of the refuse container.

BRIEF DESCRIPTION OF THE DRAWINGS

Figure 1:
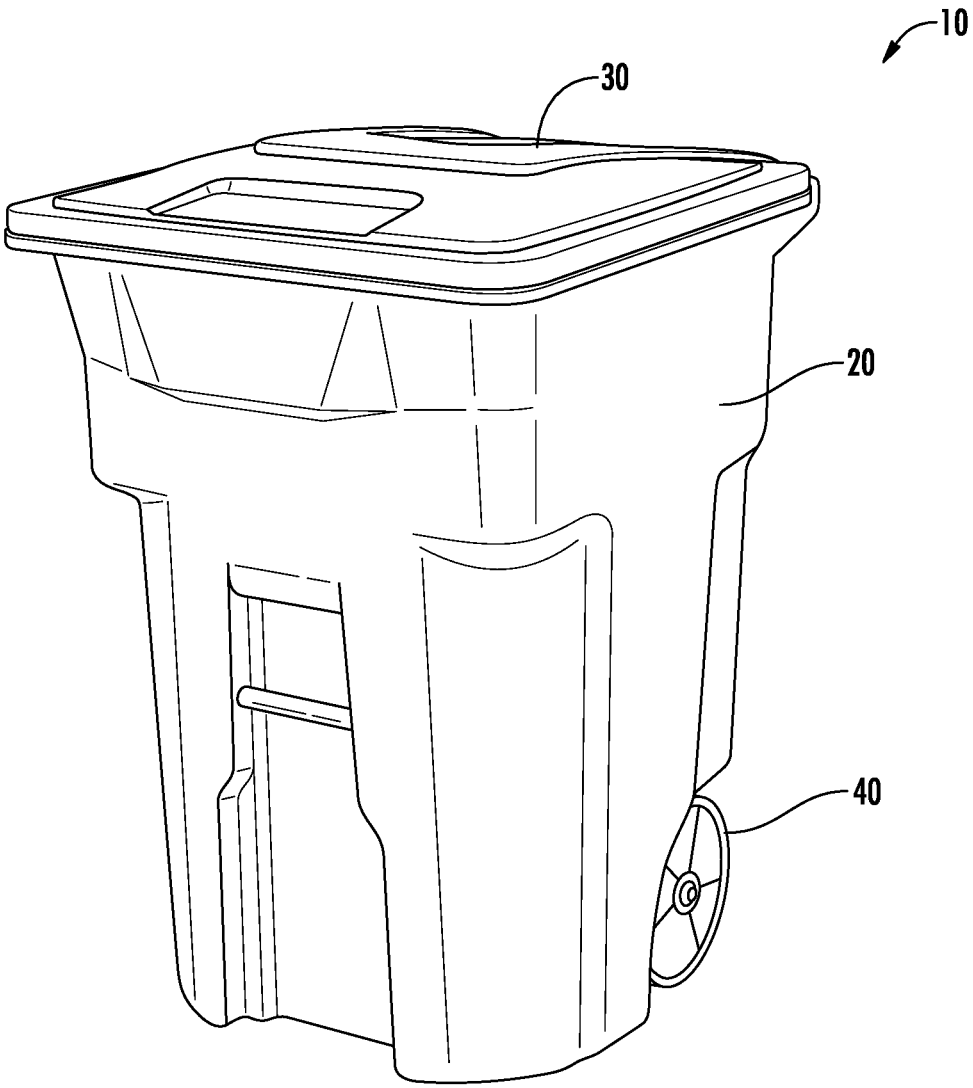
FIG. 1 (PRIOR ART)
Figure 2:
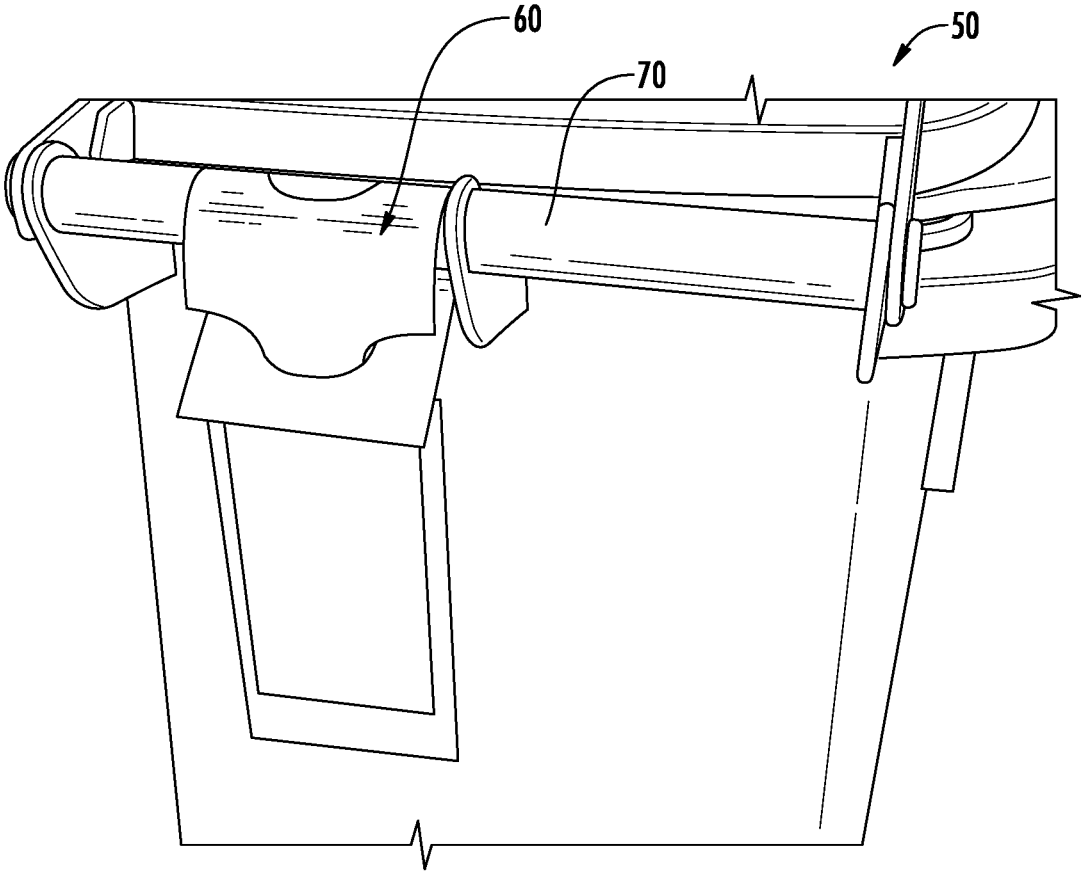
FIG. 2 (PRIOR ART)
Figure 3:
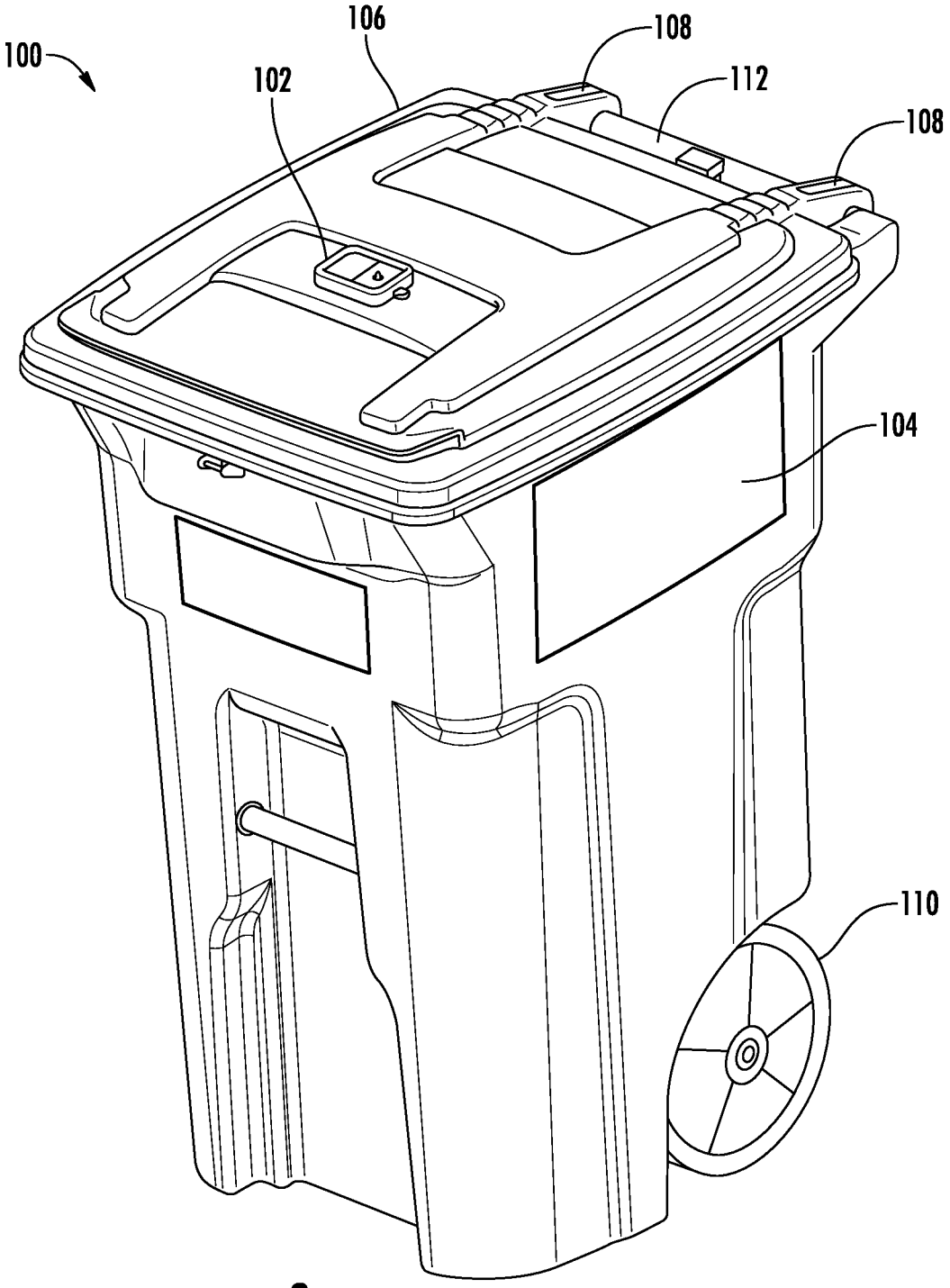
Figure 4:
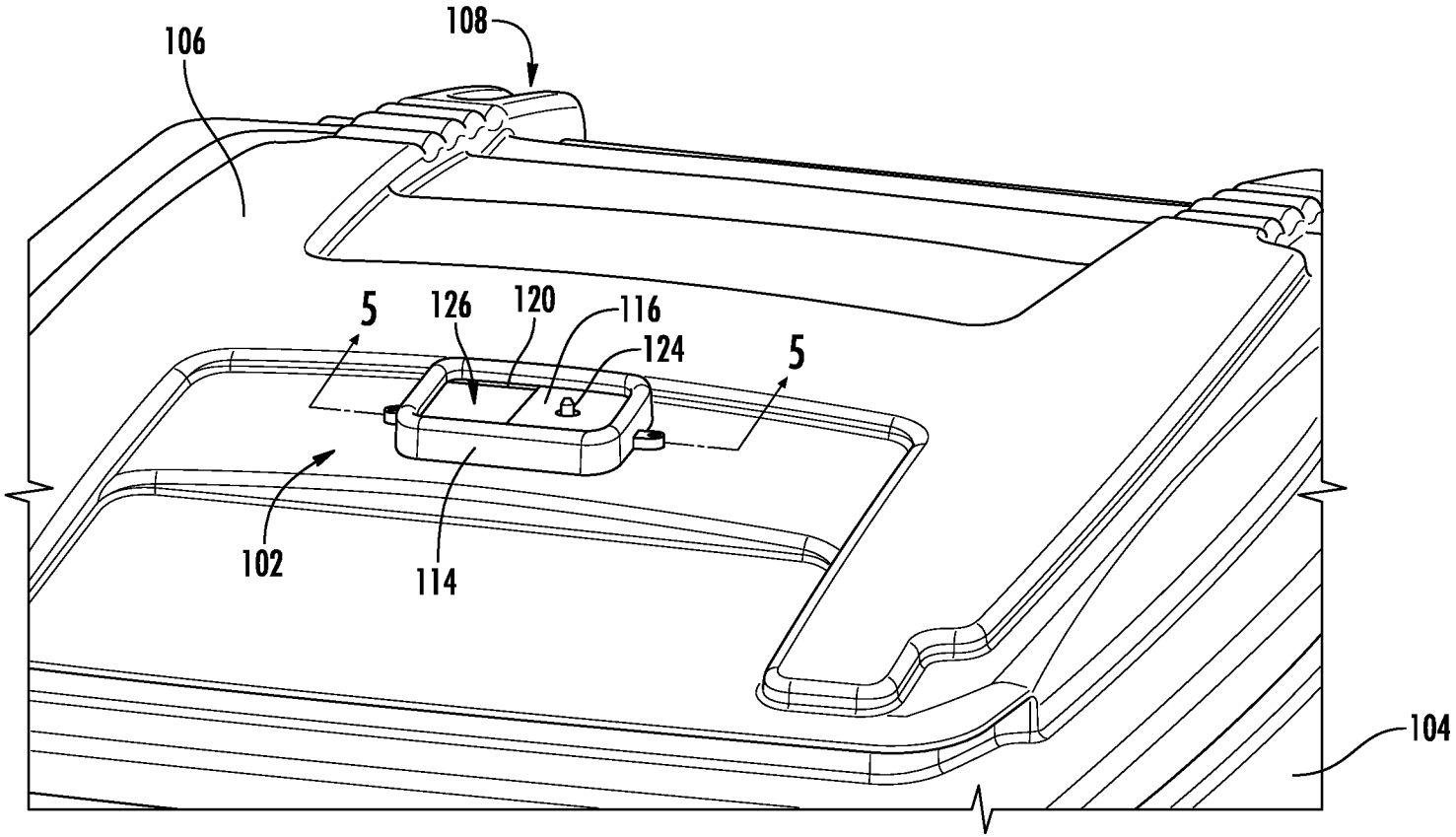
Figure 5:
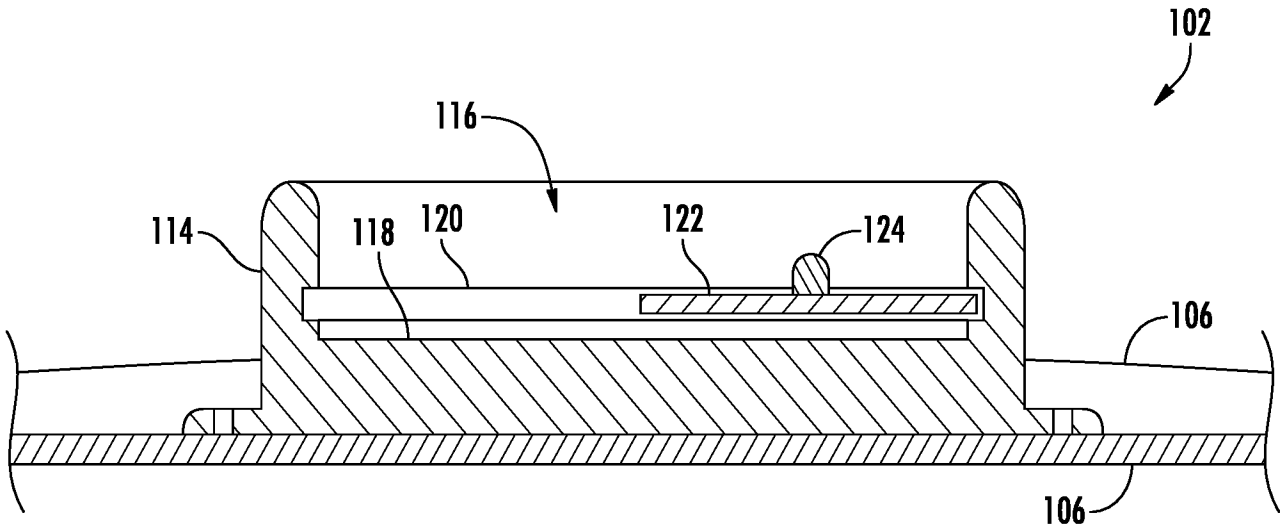
Figure 6:
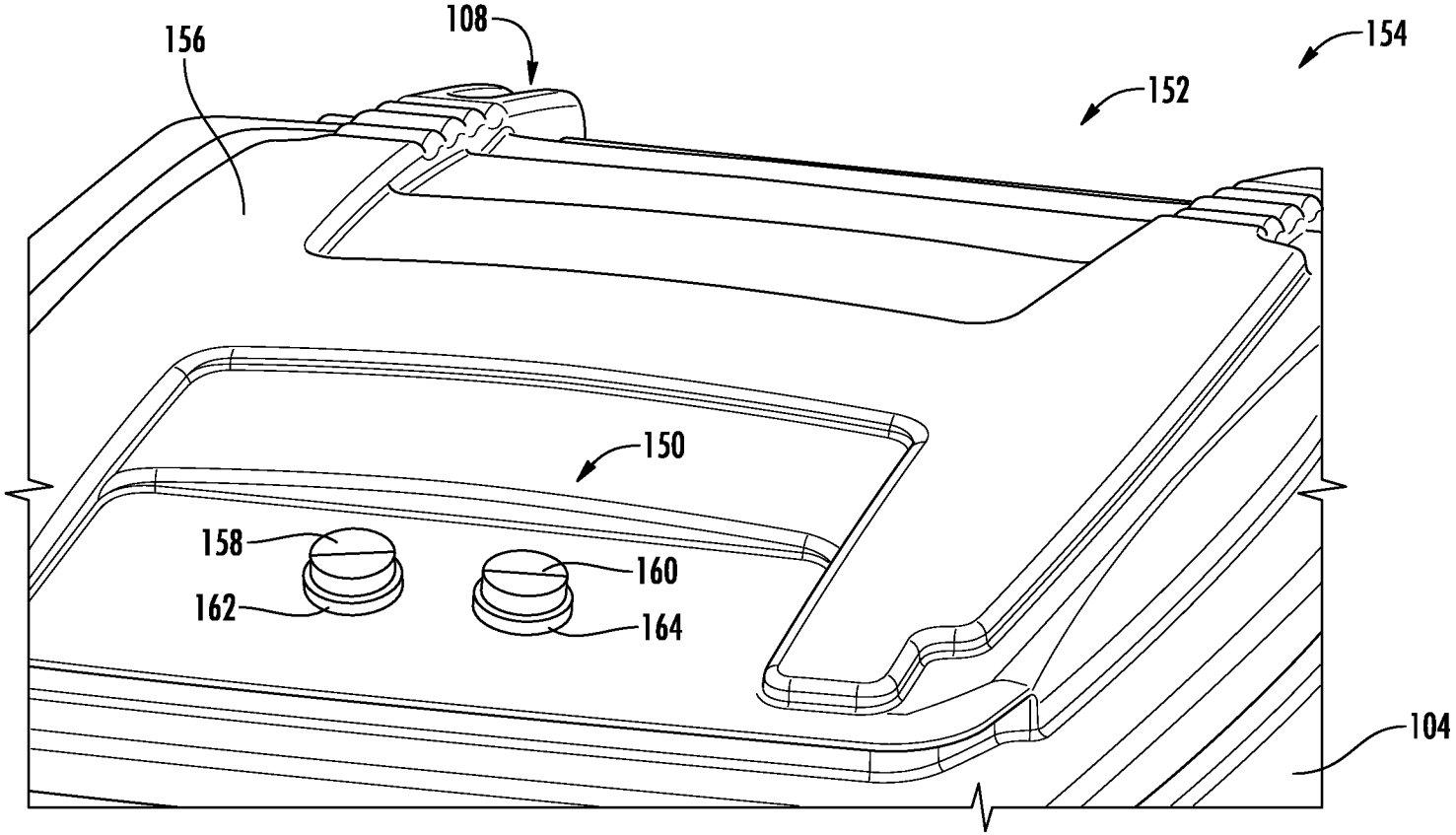
Figure 7:
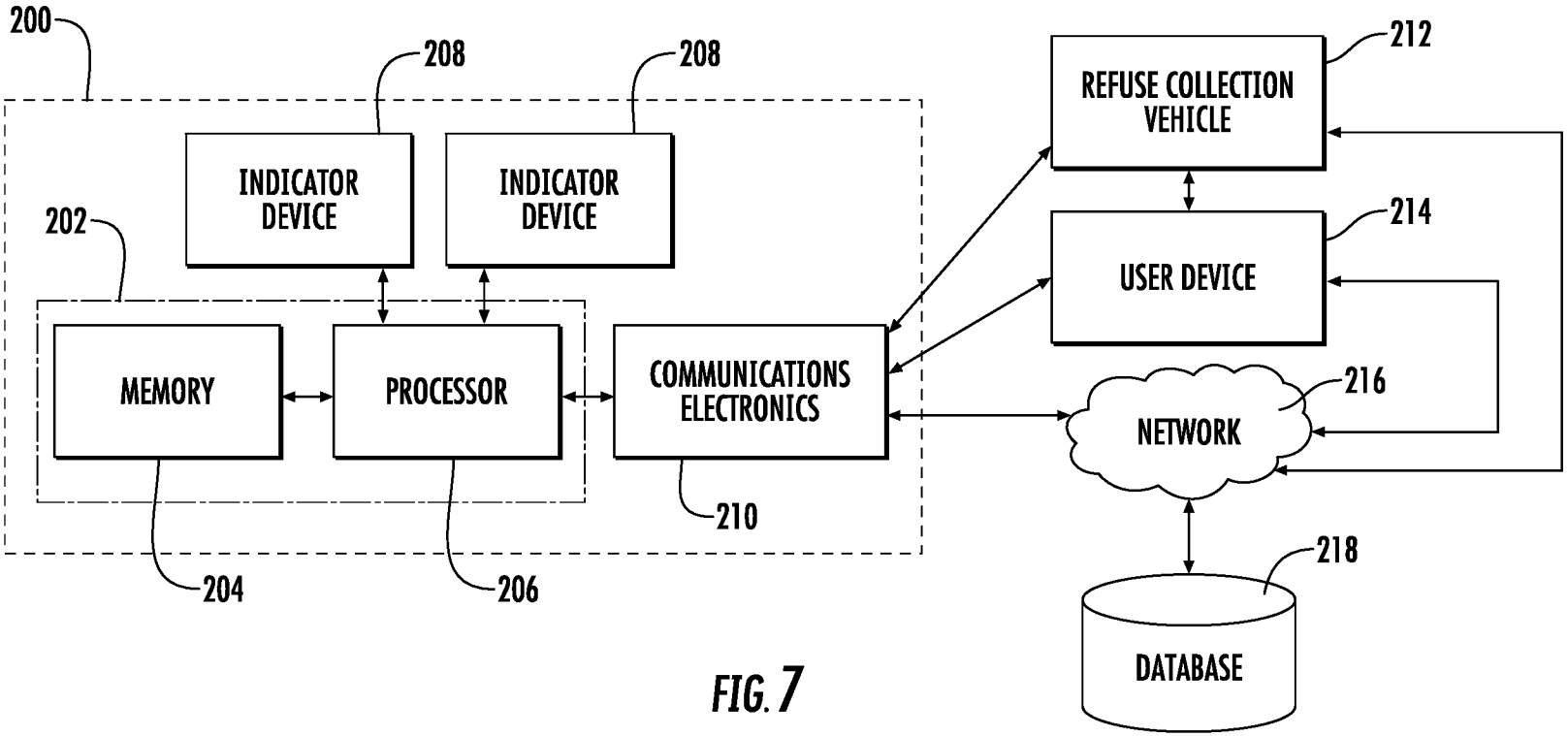
Figure 8:
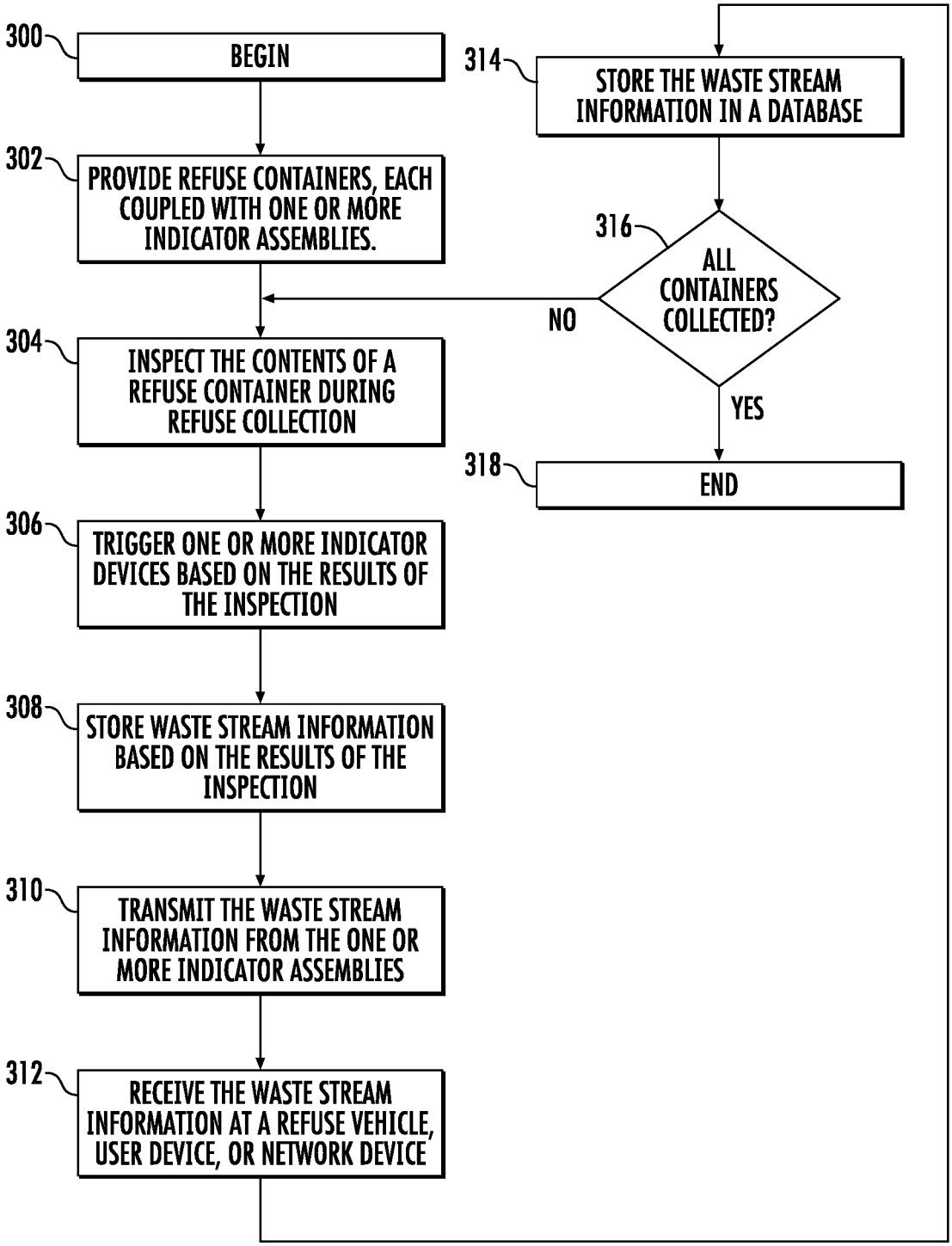

Having thus described some example embodiments in general terms, reference will now be made to the accompanying drawings, which are not necessarily drawn to scale, and wherein:

FIG. 1 is a perspective view of a refuse container according to the prior art;

FIG. 2 is a detail perspective view of a refuse container with a prior art "oops tag" attached to a handle thereof;

FIG. 3 is a perspective view of a container comprising an indicator assembly according to an embodiment of the present invention;

FIG. 4 is a detail perspective view showing the indicator assembly associated with the container of FIG. 3;

FIG. 5 is a cross-sectional view taken along the line 5-5 in FIG. 4;

FIG. 6 is a detail perspective view of an indicator assembly according to another embodiment of the present invention coupled with a container body;

FIG. 7 is a block diagram of an indicator assembly according to yet another embodiment of the present invention; and FIG. 8 is a flow diagram illustrating steps of a method in accordance with an embodiment of the present invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Under current industry practice, MRFs and waste/recyclable haulers have little recourse toward waste generators who introduce contaminants into various waste streams. By the time the MRF identifies contamination, the MRF cannot assess responsibility because material in a given waste stream will be commingled. Haulers and MRFs have an interest in educating waste generators, including residential customers and businesses, regarding compliance and non-contamination. Embodiments of the present invention relate to providing feedback to waste generators such as residential customers, which can support long-term changes both with respect to a specific waste stream (such as the recycling waste stream) and in customer behavior. Ultimately, "healthier" waste streams will result.

In this regard, some example embodiments comprise indicator assemblies for use with refuse containers. Also, in some embodiments, a refuse container may be manufactured with an integrated indicator assembly. In some embodiments, the indicator assembly preferably includes one or more components that may be manipulated in response to the presence of contaminants deposited in the container. As discussed below, such components may include various mechanical components that are manually manipulable and may be either coupled with or integrated in a portion of a refuse container, such as the lid or receptacle portion thereof. Among others, such components may include buttons, slide mechanisms, dials, and pointers or arrows. Manipulation of these one or more components preferably provides information to the user of the container, such as regarding compliance or non-compliance with rules regarding waste stream contamination and/or the specific types of contaminants that are present. In some embodiments, the information may be conveyed to the user of the container via indicia associated with the indicator assembly that are visible to the user. Additionally, in some embodiments, information may be read electronically from an indicator assembly, and this information may be compiled in a database. The database may be used, for example, by an MRF, municipal or private company hauler, or the waste generators themselves to assess overall customer compliance and to lower contamination and costs. Aspects of these and other embodiments are described in greater detail below.

Although exemplary embodiments are described below in the context of the refuse containers shown in the Figures, those of skill in the art will appreciate that the present invention is not so limited. In particular, those of skill in the art will appreciate that embodiments of the present invention may be used with other types of containers suitable for storage, collection, and transport of waste and refuse materials, including various types of residential, commercial, industrial, and institutional containers. Among others, roll-off containers, front-end load ("FEL") containers, recycling bins, materials handling carts, tilt trucks, stationary containers, and wheeled containers all may be used with embodiments of the present invention. Further, although embodiments are shown wherein an indicator assembly is provided on or integral with the receptacle portion or lid of one type of refuse container, it is contemplated that indicator assemblies in accordance with the present invention can be associated with any suitable portion of any suitable refuse container.

Turning now to the Figures, FIG. 3 is a perspective view of a container 100 comprising an indicator assembly 102 according to an embodiment of the present invention. FIG.

4 is a detail perspective view showing the indicator assembly 102. FIG. 5 is a cross-sectional view taken along the line 5-5 in FIG. 4.

In general, container 100 includes a walled receptacle portion 104 and a lid 106, which combine to form an enclosed space. Lid 106 may be attached to receptacle portion 104 via a plurality of hinges 108. However, additional embodiments of container 100 may not include a lid or may include a lid that is not connected to the receptacle portion 104 or is connected to the receptacle portion by a mechanism other than hinges. Container 100 is provided with a pair of wheels 110, one of which is shown in FIG. 3, and a handle 112.

The shape and configuration of container 100 may vary in various embodiments. As shown in FIG. 3, container 100 in this embodiment has a generally four-sided polygonal shape when viewed from the top. Again, however, embodiments of the present invention are not limited to use with containers shaped like container 10; additional embodiments are contemplated with containers having a variety of suitable shapes.

Containers used in embodiments of the present invention, including container 100, may be formed of one or more of a variety of suitable materials. The particular material is generally selected to be compatible with the intended contents and purpose and desired qualities of the container 100. For example, in various embodiments, the container 100 may be made from one or a combination of thermoplastic or elastomeric materials, such as plastic. In various additional embodiments, the container 100 may be made from one or a combination of metals, such as steel or aluminum.

Containers used in embodiments of the present invention, including container 100, may be manufactured by one of a variety of methods of making containers that are well known in the art. Good results are obtained using rotational, injection or blow molding processes with a variety of thermoplastic and elastomeric materials. Accordingly, in various embodiments according to the instant invention, a container 100 may be made from one or a combination of thermoplastic or elastomeric materials, such as: polyesters, Polycarbonate (PC), polypropylene (PP), polyethylene (PE), High Density Polyethylene (HDPE), Low Density Polyethylene (LDPE), Polyvinyl Chloride (PVC), polyester terphthalate, butadiene-styrene co-polymers, polyamides, ethylene-vinyl-alcohol copolymer, polyethylene napthaphthalate, thermoplastic and thermosetting resins, polybutylene terephthalate, polyoxymethylenes, polyphenylene, polyphenylene sulfides, polyphenylene oxides, polymethylmethacrylate, polyethylene-terephthalate (PET), polyvinylidenechloride, polymethylpentene-1, nylon 6, nylon 66, Polyethylene Terephthalate Modified with CHDM (PETG), and mixtures thereof. In some embodiments, container 100 may be analogous to the rotationally-molded two-wheel carts manufactured by Toter, LLC of Charlotte, N.C.

As best seen in FIG. 4, in this embodiment indicator assembly 102 is coupled with lid 106 of container 100. However, as discussed herein, in other embodiments indicator assembly 102 may be disposed on any portion of container 100, such as but not limited to receptacle portion 104. Additionally, in some embodiments, container 100 may be manufactured to include an integral indicator assembly, or at least a housing portion thereof.

As shown, indicator assembly 102 comprises a housing 114. In this embodiment, housing 114 may be generally rectangular in shape, though as discussed below that is not required in all embodiments. Housing 114 comprises four vertical walls that together define an open-topped enclosed space 116. In some cases, housing 114 may also define a generally horizontal bottom wall 118 coupled with the vertical walls (see FIG. 5). As discussed in greater detail below, indicia may be provided on bottom wall 118 in some embodiments. The interior portions of at least two of the walls of housing 114 (i.e., those portions facing enclosed space 116) define a longitudinal slot 120. Slot 120 may extend generally along the length of the walls in which it is defined, and in some embodiments it may extend along all four walls of housing 114 such that slot 120 extends continuously around the interior faces of the walls that define enclosed space 116.

Indicator assembly 102 preferably also comprises an indicator device, which as shown comprises a panel 122. In this embodiment, panel 122 is a thin, relatively flat component that is dimensioned to be slidably received in slot 120. Slot 120 preferably is dimensioned to prevent removal of panel 122 but to allow sliding movement of panel 122 therein. In the illustrated embodiment, a knob 124 is provided on panel 122 to allow a user to move panel 122 along slot 120 from one end of housing 114 to the other. Thus, when panel 122 is positioned at one end of housing 114, one portion of bottom wall 118 is visible, and when panel 122 is positioned at the opposite end of housing 114, a different portion of bottom wall 118 is visible. In alternative embodiments, when panel 122 is positioned at one end of housing 114, one portion of bottom wall 118 is visible, and when panel 122 is positioned at the opposite end of housing 114, no portion of bottom wall 118 may be visible—in other words, there may be a separate component beneath panel 122 in FIG. 4, which may or may not be slidable, that covers a portion of bottom wall 118.

It is contemplated that an indicator assembly in accordance with the present invention be robust against the harsh elements and rigorous operating environments to which containers 100 are typically exposed. Thus, for example, in some embodiments, some or all of the components of indicator assembly 102 may be formed from the same material as container 100, such as the thermoplastic and elastomeric materials discussed above. For instance, in one embodiment, housing 114 of indicator assembly 102 is integrally formed with receptacle portion 104 during manufacturing, such as by a rotational molding process. In other words, receptacle portion 104 may define housing 114 therein in some embodiments, rather than housing 114 being fastened to receptacle portion 104 following manufacturing of receptacle portion 104. Likewise, in another embodiment, housing 114 of indicator assembly 102 is integrally formed with lid 106 during manufacturing, such as by a blow molding process. In other words, lid 106 may define housing 114 therein in some embodiments. In such embodiments, panel 122 may be inserted into housing 114 after manufacturing. Those of skill in the art will appreciate that integrally forming housing 114 with a portion of container 100 may enhance the strength and durability of indicator assembly 102.

In other embodiments, some or all of the components of indicator assembly 102 may be formed from a suitable metal, such as steel or aluminum, in some embodiments. Those of skill in the art are familiar with suitable materials from which components of indicator assemblies described herein may be made, and they may select suitable materials depending, for example, on the type of container with which the indicator assembly is used and its environment, the type of indicator assembly used, and the type of refuse involved.

As noted above, bottom wall 118 may be provided with indicia 126 (see FIG. 4). Indicia associated with indicator assembly 102 preferably provides visual (or otherwise perceptible) information related to refuse deposited in container 100, such as information regarding whether or not the deposited refuse contains contaminants of a particular waste stream. Such perceptible information may be in the form of text, color(s), or the like, but it is not so limited. In the illustrated embodiment, and by way of example only, the portion of bottom wall 118 that is visible when panel 122 is positioned at one end of housing 114 may be red in color, whereas the portion of bottom wall 118 that is visible when panel 122 is positioned at the opposite end of housing 114 may be green in color. Alternatively, one portion of bottom wall 118 may be red in color, and the other portion of bottom wall 118 may have no color or other indicia thereon. In other embodiments, for instance, one portion of bottom wall 118 could have the indicia "NO" provided thereon, and another portion of bottom wall 118 could have the indicia "YES" provided thereon. As discussed herein, many other types of suitable indicia and many other embodiments are contemplated. In various embodiments, indicia may be provided on bottom wall 118 in any manner known to those of skill in the art, such as via hot stamping, molding, etching, stickers, or suitable adhesives.

In operation of indicator assembly 102 in accordance with an embodiment of the invention, a waste generator may place container 100 out for collection of the refuse deposited therein, as is understood. Upon arrival at each container, personnel associated with the waste collector or hauler may perform a visual inspection of the contents of container 100. If contaminants are found in container 100, the personnel may manipulate panel 122 so that indicia representative of contamination are visible. For instance, in the embodiment discussed above, personnel may slide panel 122 so that panel 122 covers the "green" portion of bottom wall 118 and leaves the "red" portion visible. Personnel may then decline to collect the refuse in container 100. When the waste generator returns to container 100, he or she will see indicator assembly 102 indicates that contaminants were present and, if applicable, the reason his or her refuse was not collected. Again, though, as discussed herein, it is contemplated that the waste generator could receive a variety of additional and/or different information via indicator assembly 102. Prior to the next scheduled collection, the waste generator may "reset" panel 122 by moving it to the opposite position.

Indicator assembly 102 and its indicator device(s) may be modified in many ways within the scope of the present disclosure. For instance, in some embodiments, the indicator assembly may comprise a circular housing with a panel disposed therein that comprises a portion of a circle. The panel may be rotatable to display, for example through a cutout portion, indicia corresponding to the type of contaminated refuse present in a container (e.g., "plastic bags") or another problem or reason the refuse could not be collected (e.g., "path obstructed" or "tied bags"). When rotated to the appropriate position, the panel may correspondingly cover non-applicable indicia, rendering it not visible. In other embodiments, rather than a panel analogous to panel 122, an indicator assembly may comprise an indicator device in the form of a clickable dial that is rotatable to indicate one or more specific issues. Also, as discussed herein, in some embodiments, an indicator assembly may have multiple manipulable components, for example to convey additional or more detailed information to a waste generator. For instance, an indicator assembly may comprise multiple slidable panels, actuatable buttons, rotatable dials, or the like, each of which may correspond to a different type of contaminated waste. Alternatively, multiple indicator assemblies may be provided on or integrated with a refuse container.

In some cases, the indicator assembly housing need not define a slot analogous to slot 120, and a panel may nonetheless be slidable or otherwise manipulable relative to the housing. For instance, a housing may define a top wall, and the panel may be slidable or otherwise manipulable within the housing underneath the top wall. The top wall may comprise a partially transparent portion, or it may have an aperture defined therein. A knob or other suitable mechanism may be used to cause the panel to slide or rotate within the housing. For instance, a knob may protrude from one of the walls of the housing through an aperture defined therein. Alternatively, the panel may be slidable or rotatable in response to insertion and turning of a key, movement of a magnet, etc. In any event, various indicia may be provided on the panel itself, and movement of the panel may cause a portion of the panel bearing applicable indicia to be visible to a waste generator through the transparent portion or aperture in the top wall.

Of course, the housing may be any of a variety of suitable shapes, and in some embodiments the indicator assembly may have no housing at all. For instance, the indicator assembly may comprise a translatable or rotatable component that can be horizontally or vertically translated, or rotated, to be adjacent to indicia that are provided on lid 106 or receptacle portion 104. The indicator assembly housing, where provided, also need not be on the exterior of container 100. The housing, for example, may be provided on the underside of lid 106 or the interior of receptacle portion 104. A movable panel may make applicable indicia viewable through a transparent portion of the lid or container receptacle portion or an aperture defined in the lid or container receptacle portion.

Likewise, indicia associated with the indicator assembly may be any type of information in any form that is perceptible to a waste generator. It may comprise colors, textual, and or audible information, in any form, including but not limited to printed, molded, braille, stamped, etched, dyed, and/or adhered indicia. Indicia may not be on any component of the indicator assembly, and it may instead by on a nearby or adjacent component of container 100. For example, indicia could be provided on lid 106 or receptacle portion 104, and arrow(s) may be defined on panel 122 so that panel 122 may be moved to a position in which an arrow points to the appropriate indicia. Alternatively, indicia could be provided on a portion of lid 106 or receptacle portion 104, and panel 122 may be positioned to be slidable relative to the indicia such that the indicia on lid 106 or receptacle portion 104 is either covered (and thus not visible to a waste generator from the exterior of container 100) or uncovered (and thus visible to a waste generator from the exterior of container 100). The indicator assembly may also include one or more electronic displays to display indicia in some embodiments.

FIG. 6 is a detail perspective view of an indicator assembly 150 according to another embodiment of the present invention coupled with a container body 152 of a container 154. Container 154 preferably is analogous to container 100 described above. In this embodiment, indicator assembly 150 is coupled with a lid 156 of container body 152, but as noted above, indicator assembly may be coupled with any suitable portion of container body 152. Indicator assembly 150 preferably comprises one or more user-actuatable buttons. As shown, for example, indicator assembly 150 comprises two such buttons 158, 160. Buttons 158, 160 are disposed in respective housings 162, 164 that are suitable attached to lid 156, such as via fasteners or adhesive. In some alternative embodiments, housings 162, 164 may be integrally formed with lid 156, such as during a blow-molding process.

In accordance with various embodiments, buttons 158, 160 are preferably configured such that actuation thereof may inform a waste generator of contamination in a waste stream. For instance, buttons 158, 160 may respectively comprise indicia in the form of the colors green and red. In addition or in the alternative, when a force is applied to either of buttons 158, 160, buttons 158, 160 may be held in a depressed or actuated state by a spring-catch mechanism or the like. The depressed state of a particular one of buttons 158, 160 may be indicative of compliance or non-compliance with rules regarding waste stream contamination. Alternatively, when a force is applied to either of buttons 158, 160, an internal light may cause buttons 158, 160 to illuminate a particular color (such as red or green), and subsequent application of force to buttons 158, 160 may cause the internal light to turn off. In yet another embodiment, actuation of a button 158 or 160 may cause an internal processor to write information to memory, such as information representative of the fact that a waste stream was contaminated on a particular date at a particular time. Those of ordinary skill in the art are familiar with and can select or provide suitable buttons for these and other similar purposes in various embodiments.

In operation of indicator assembly 150 in accordance with an embodiment of the invention, a waste generator may place container 154 out for collection of the refuse deposited therein, as is understood. Upon arrival at each container, personnel associated with the waste collector or hauler may perform a visual inspection of the contents of container 154. If contaminants are found in container 154, the personnel may actuate either or both of buttons 158, 160, as appropriate, so that indicia representative of contamination are visible. For instance, in various embodiments, personnel may actuate button 160 so that button 160 is held in a depressed state via a spring-catch mechanism, so that an internal light causes button 160 to illuminate a red color, and/or so that information is written to internal memory regarding the presence of contaminants in the waste stream. Personnel may then decline to collect the refuse in container 154. When the waste generator returns to container 154, he or she may see indicator assembly 150 indicates that contaminants were present and, if applicable, the reason his or her refuse was not collected. Again, though, as discussed herein, it is contemplated that the waste generator could receive a variety of additional and/or different information via indicator assembly 150. As discussed below, for example, the waste generator may access a database via a suitable electronic device having a wired or wireless connection to the Internet to view information regarding compliance and/or non-compliance on a given pick-up date.

FIG. 7 is a block diagram of an indicator assembly 200 according to yet another embodiment of the present invention. Indicator assembly 200 may be coupled with any suitable refuse container, including but not limited to containers analogous to containers 100, 154 described above. As shown, indicator assembly 200 may comprise processing circuitry 202. In one embodiment, processing circuitry 202 may include a memory 204 in communication with a processor 206. In some embodiments, as described herein, one or more indicator devices 208 may be in operative electronic communication with processor 206. Indicator devices 208 may be any suitable indicator device as described herein. Although not shown in FIG. 7, it will be appreciated that a battery, capacitor, or other suitable power source or circuitry may be provided in indicator assembly 200 in various embodiments. In some embodiments, such as those employing RFID communications techniques, the power source or circuitry may also be an alternative energy storage unit that is charged by electromagnetic energy when the indicator assembly 200 is in the field of an interrogator signal.

Processing circuitry 202 preferably is configured to perform communications control, data processing, application execution, and/or other processing according to various embodiments of the present invention described herein. The processing circuitry 202 may be embodied as a circuit chip (e.g., an integrated circuit chip) configured (e.g., with hardware, software or a combination of hardware and software) to perform operations described herein. The processing circuitry 202 may be configured to control one or more functions of one or more elements of the indicator devices 208 through computer program instructions (e.g., software and/or firmware) stored on a memory device accessible to the processing circuitry 202 (e.g., volatile memory, non-volatile memory, and/or the like). For example, processor 206 of processing circuitry 202 may also be configured to write information to memory 204 based on operation or manipulation of indicator devices 208. Such information may include, for example, the date and time an indicator device 208 was actuated; that the contents of a container contained, or did not contain, waste stream contaminants; the type(s) of contaminants present in the contents of the container; whether refuse in the container was collected; and/or any other information desirable to those of skill in the art. The processing circuitry 202 may also comprise, or be in communication with, display circuitry configured to display at least a portion of a user interface which may be used, for example, to access information stored in memory 204. Further, the display and display circuitry may be configured to display the indicator devices 208 (e.g., on a touchscreen or the like). Thus, in some embodiments, the display and the display circuitry may be configured to facilitate user control of at least some functions of the indicator assembly 200.

The memory 204 of processing circuitry 202 may be any suitable memory or computer-readable medium as long as it is capable of being accessed by the control system, including random access memory (RAM), read-only memory (ROM), erasable programmable ROM (EPROM), or electrically EPROM (EEPROM), CD-ROM, DVD, or other optical disk storage, solid-state drive (SSD), magnetic disc storage, including floppy or hard drives, any type of suitable non-volatile memories, such as secure digital (SD), flash memory, memory stick, or any other medium that may be used to carry or store computer program code in the form of computer-executable programs, instructions, or data. Processing circuitry 202 may also include a portion of memory accessible only to processing circuitry 202.

In some embodiments indicator assembly 200 may also include communications electronics 210 in electronic communication with processing circuitry 202. As described in more detail below, communications electronics 210 preferably enables communication between indicator device 200 and corresponding communications electronics associated with one or more of a refuse collection vehicle 212, a user device (e.g., a handheld reader, PC, tablet computer, and/or smartphone) 214, and/or a network 216. Thereby, for example, information stored in memory 204 may be transferred to a database 218 accessible by haulers, MRFs, and/or waste generators themselves.

In some embodiments, the communication electronics 210 may be any means, such as a device or circuitry embodied in either hardware, software, or a combination of hardware and software, that is configured to receive and/or transmit data from/to any of refuse collection vehicle 212, user devices 214, and/or network 216 and/or any other device or module in communication with the processing circuitry 202. In some instances the communication electronics 210 may provide secured or encrypted communication between the processing circuitry, refuse collection vehicle 212, user devices 214, and/or network 216. Communication electronics 210 may also include, for example, an antenna (or multiple antennas) and supporting hardware and/or software for enabling communications with refuse collection vehicle 212, user devices 214, and/or network 216. In some environments, the communication electronics 210 may alternatively or additionally support wired communication. As such, for example, the communication electronics 210 may include a communication modem and/or other hardware/software for supporting communication via cable, digital subscriber line (DSL), universal serial bus (USB) or other mechanisms.

In an exemplary embodiment, the communication electronics 210 may support communication via one or more different communication protocols or methods. In one embodiment, communication electronics 210 may comprise a wireless radio operative to communicate with refuse collection vehicle 212, user devices 214, and/or network 216 using radio frequency signals with wavelengths in the ISM radio bands, though this is not required in all embodiments. In some embodiments, wireless communications may be implemented using a suitable short-range communications protocol, such as NFC, Bluetooth Low-Energy (also known as Bluetooth Smart), Peanut, Zigbee, Wi-Fi, radio frequency identification (RFID), or the like, though any suitable wireless communication protocol may be used with embodiments of the present invention. For instance, in some embodiments, communications electronics 210 may comprise a wireless radio suitable for transmitting information to another device using 3G, 4G, or LTE standards, and in other embodiments, communication electronics 210 may communicate via infrared signals. It will be appreciated that the permissible distance between communication electronics 210 and refuse collection vehicle 212 or user devices 214 will depend on the type of wireless communications used or the wireless communication standard implemented with communication electronics 210, among other factors.

Refuse collection vehicle 212 may be any vehicle designed to collect the contents of a container to which indicator assembly 200 is coupled. For instance, refuse collection vehicle 212 may be analogous to a garbage or recycling truck operative to collect garbage or recycling stored in roll-off carts, except modified in accordance with embodiments of the present invention. Refuse collection vehicle 212 preferably is provided with communications electronics and suitable processing circuitry to communicate with communications electronics 210 and processing circuitry 202, as described above. Such communications electronics may, for example, be operated by a driver or occupant of the refuse collection vehicle 212 while refuse collection vehicle 212 is driving along a collection route.

User device 214 may be any suitable portable computing device known to those of skill in the art, such as but not limited to computer monitors, tablet computers, laptops, and cell phones. Again, user device 214 is preferably in selective wired or wireless electronic communication with processing circuitry 202 via suitable communications electronics. In particular, user device 214 may comprise a processor and memory configured to generate a graphical user interface from which a user may write to and/or read from memory 204. Also, in some embodiments, a user may use user device 214 to send commands to processing circuitry 202 and may actuate indicator devices 208 thereby or perform other functions associated with indicator assembly 200.

Where employed, the network 216 may be a data network, such as a local area network (LAN), a metropolitan area network (MAN), a wide area network (WAN) (e.g., the Internet), and/or the like, which may communicatively couple indicator assembly 200 to devices such as processing elements (e.g., computer terminals, server computers or the like) and/or databases. For instance, indicator assembly 200 may be in remote electronic communication with database 218 via network 216, either directly or indirectly through refuse collection vehicle 212 and/or user device 214. As noted above, communication between the network 216, the indicator assembly 200, and the devices or databases (e.g., servers) to which the indicator assembly 200 is coupled may be accomplished by either wireline or wireless communication mechanisms and corresponding communication protocols.

Database 218 may be any suitable database known to those of skill in the art. Database 218 may be used to compile information stored in the memories 204 associated with a plurality of indicator assemblies 200 coupled with a plurality of containers. The database 218 may be located at any location, and it may be maintained, for example, by a waste hauler, MRF, municipality, or the like. Thereby, the hauler, MRF, and/or municipality may compile information regarding its customers' compliance with rules regarding contamination in waste streams, including but not limited to data regarding the types and/or amount of contaminants present in the waste stream, particular contaminants introduced by each customer, repeat offenders, rates of change of customer compliance, the dates on which contaminants were introduced, whether particular containers containing contaminants were picked up, etc. In some embodiments, database 218 preferably also is accessible by customers themselves, for example to view their individual data. Thus, for instance, a customer may determine the reason his or her container was not collected on a given date or the types of contaminants typically included in the customer's container.

Embodiments of the present invention provide methods, apparatus and computer program products for collecting and storing information regarding a waste stream. Various examples of operations performed in accordance with embodiments of the present invention are described herein, and one particular example will now be provided with reference to FIG. 8. In this regard, FIG. 8 is a flow diagram illustrating steps of a method of collecting waste stream information regarding a plurality of refuse containers, each having an indicator assembly as shown in FIG. 7, in accordance with an embodiment of the present invention. The method of FIG. 8 may be performed with indicator assemblies according to various embodiments of the present invention, and reference is made to the indicator assembly 200 of FIG. 7 by way of example only. Additionally, as described in more detail below, various embodiments of the method of FIG. 8 do not require all steps to be performed, or to be performed in the particular order shown.

Referring now to FIG. 8, at step 300, the method begins. At step 302, refuse containers each having one or more indicator assemblies 200 coupled thereto are provided. This may be done in any manner described herein. In one example, the containers may be manufactured to include the indicator assemblies 200, but in other examples, waste hauling companies, MRFs, and/or municipalities may provide indicator assemblies 200 to customers to be coupled with containers that are already in use. In various embodiments, either the customers or the waste hauling companies, MRFs, and/or municipalities may couple the indicator assemblies with the containers.

As those of skill in the art will appreciate, customers or waste generators will fill their refuse containers with refuse to be collected by a municipality or waste hauling company on a scheduled pickup date. However, in some cases the customers or waste generators also will deposit waste stream contaminants in their refuse containers. On the scheduled pickup date, personnel associated with the entity collecting the refuse may collect refuse from a plurality of containers assigned to a plurality of customers, for example, customers located along a defined route or living in a defined area.

At step 304, personnel associated with the entity collecting the refuse may inspect the contents of a given refuse container for contaminants. In various embodiments, such personnel may be an individual or individuals walking alongside or ahead of the refuse collection vehicle 212, and in some embodiments such personnel may be carrying a user device 214, though this is not required in all embodiments. In other embodiments, such personnel may be the driver of the refuse collection vehicle 212. Finally, in still other embodiments, inspection may be performed by an independent monitor.

At step 306, based on the results of the inspection of the container's contents, personnel associated with the entity collecting the refuse may trigger one or more indicator devices, such as indicator devices 208, associated with one or more indicator assemblies 200 coupled with the container. The triggering action may inform a customer or waste generator, directly or indirectly, that contaminants (generally or particularly) are or are not present in the container. The triggering action may also result in the generation of waste stream information and/or such being stored in memory, as described in more detail herein. By way of example, if personnel determines that the container contains waste stream contaminants, personnel may actuate an indicator device (e.g., by depressing a button, by sliding a panel, turning a dial, etc.). In some embodiments, personnel may perform the triggering action manually, but in other embodiments wherein an indicator assembly analogous to indicator assembly 200 is used, the triggering action may also be performed remotely. This may be done, for example, via suitable wireless communications electronics provided on refuse collection vehicle 212 and/or user device 214.

Depending on the particular embodiment, the indicator device may inform a customer or waste generator that his or her container contained waste stream contaminants in various ways. As described above, the indicator device may display or point to perceptible indicia corresponding to this information (either on the indicator assembly and/or the container body itself), the indicator device may comprise a button of a particular color that is depressed, a light may be lighted as a result of the indicator device being triggered, etc. Alternatively or in addition, the indicator device(s) may inform a customer or waste generator of the particular type of contaminants contained in the waste stream in various ways. Further, in some embodiments, actuation of an indicator device may also indicate to a customer or waste generator that no contaminants were present. Finally, in various embodiments, actuation of an indicator device may not display any visually perceptible information to a customer or waste generator at all but may perform other functions as described herein. As described below, in such an embodiment, a customer or waste generator may access a database to review his or her waste stream information.

Next, at step 308, in some embodiments, waste stream information may be stored in memory. For instance, as described above with respect to FIG. 7, indicator devices 208 may be operably connected with processing circuitry 202, such that triggering of an indicator device 208 may cause processor 206 to write waste stream information to memory 204. Additionally or in the alternative, triggering of an indicator device 208 may cause processing circuitry 202 and communications electronics 210 to transmit waste stream information to any or all of refuse collection vehicle 212, user device 214, and/or a device forming a part of network 216, and the waste stream information may be stored at any of refuse collection vehicle 212, user device 214, and/or the network 216 device. Waste stream information may be, for example, date and time, customer-specific information (e.g., names and addresses), information representative of compliance and/or non-compliance with rules regarding waste stream contamination, information representative of the type of contaminant present in the container, information representative of the amount or percentage of contaminants present in the container, whether the refuse in the container was collected, and/or any other information described herein or desirable to those of skill in the art. Finally, as noted above, in some embodiments, waste stream information may not be stored in memory at all. Indeed, in one such embodiment, personnel may record compliance, non-compliance, and/or other related waste stream information manually, and this information may be input into a database at a later time.

At step 310, the waste stream information may be transmitted from the one or more indicator assemblies coupled with the container, for example via communications electronics 210. Transmission may occur immediately upon or shortly after the indicator device(s) are triggered, or transmission may occur periodically at predetermined times. The transmission step 310 may occur in response to an interrogation or request signal sent, for example, from refuse collection vehicle 212, user device 214, or via network 216. At step 312, the waste stream information may be received at refuse collection vehicle 212, user device 214, or at a network 216 device.

Those of skill in the art will appreciate that steps 310 and 312 may be carried out in various ways according to various embodiments within the scope of the present invention. In one embodiment, waste stream information may have been stored at an indicator assembly 200 in response to actuation of one or more indicator device(s) at step 308. Again, this may have been done by personnel walking ahead of or alongside a refuse collection vehicle 212. Then, the operator of the refuse collection vehicle 212 or a user device 214 (who may or may not be riding in vehicle 212) may send a signal via a suitable wireless communications protocol to interrogate the indicator assembly 200 and gather the information generated by actuation of the indicator device(s) 208. Alternatively, the communications electronics of the indicator assembly 200 may automatically transmit the waste stream information to the refuse collection vehicle 212 or a user device 214, either upon the triggering action or as a refuse collection vehicle 212 or a user device 214 passes the container. In any event, the waste stream information may be received at the refuse collection vehicle 212 or the user device 214, and it may be stored there temporarily, for example until the end of a collection route. The information may also be transmitted to a database as described in more detail below, either automatically or manually at a later time. In still other embodiments, the indicator assembly 200 may automatically transmit all or a portion of applicable waste stream information to a device (e.g., a computer, smartphone, or the like) associated with its corresponding customer or waste generator when the indicator device(s) are triggered.

In another embodiment, either the container itself or an associated indicator assembly 200 may be provided with or contain a passive or active radio frequency identification (RFID) tag, or transponder. Those of skill in the art are familiar with RFID techniques that may be advantageously used in accordance with the present invention. As is known, RFID systems typically comprise a tag, a transceiver, and a processor or controller. A transceiver, or interrogator, may have at least one antenna, a microprocessor, and other electronic circuitry. A tag, or transponder, often has transponder electronic circuitry and an antenna. The electronic circuitry may include a nonlinear device or semiconductor junction (such as a diode) configured to generate a harmonic of the interrogating frequency to indicate the transponder's presence. In some more complex transponders, the electronic circuitry includes an integrated circuit or other processing device for storing and processing information transmitted from and modulating a return signal to the interrogator. The electronic circuitry of the transponder may also include a capacitor and nonvolatile memory.

Passive transponders use a signal from the interrogator to provide energy which activates the transponder's circuitry, while active transponders contain an independent energy source such as a battery. Battery-assisted passive transponders are also known. In one familiar mode of operation, the interrogator sends an interrogation signal to the transponder at a first frequency, the transponder responds by transmitting a coded signal on a second frequency, and the interrogator receives and processes the coded signal. The interrogator sends the information contained in the coded signal to a controller for processing.

Accordingly, embodiments of the present invention may utilize interrogator electronics associated with a refuse collection vehicle 212 or a user device 214, and at least one transponder may be coupled with or embedded in components of the refuse container and/or indicator assembly 200. The tag may be provided with a unique identifier corresponding to a particular customer, address, or account. The interrogator electronics are preferably in electronic communication with a suitable control system.

In any event, in various embodiments, refuse collection personnel may have triggered one or more indicator devices such that indicia indicating waste stream contamination are visible at step 306, but the waste stream information need not have been stored at step 308. As refuse collection vehicle 212 and/or personnel operating a user device 214 pass the container to which indicator assembly 200 is coupled, the vehicle 212 operator or other personnel may observe the visible indicia on indicator assembly 200 indicating that waste stream contaminants are present. The vehicle 212 operator and/or personnel operating a user device 214 may then interrogate the RFID tag in indicator assembly 200 or its corresponding container. This may yield information regarding the customer, address, or account associated with the container. The vehicle 212 operator and/or personnel operating a user device 214 may input information indicating that contaminants were observed in the container, the type of contaminants, etc. Alternatively, the vehicle 212 operator and/or personnel operating a user device 214 may only interrogate those RFID tags in indicator assemblies 200 (or corresponding containers) for which the visual indicia (e.g., a red light) indicates contaminants are present, and the waste stream information may be associated with the customer account or address automatically. In this case, the vehicle 212 operator and/or personnel operating a user device 214 may not interrogate those RFID tags in indicator assemblies 200 (or corresponding containers) for which the visual indicia (e.g., a green light) indicates that no contaminants are present. In any event, the input information may again be stored temporarily, for example until the end of the collection route, in a memory device associated with the refuse collection vehicle 212 and/or the user device 214. Accordingly, in this embodiment, indicator assembly 200 may be simpler in construction than in other embodiments, and may not need to contain processing circuitry 202 and/or the communications electronics 210 apart from an RFID tag. Information may still be stored in a database for use by MRFs, waste hauling companies, municipalities, and/or customers, but also a customer may learn in person whether contaminants were present in the waste stream based on the visual indicia associated with the indicator assembly 200.

In a still further embodiment, triggering of an indicator device 208 may permit a transponder associated therewith to be read, or interrogated. When the indicator device 208 is not triggered, its associated transponder may not be interrogated. An interrogator electronics associated with refuse collection vehicle 212 and/or user device 214 may automatically attempt to interrogate transponders associated with indicator devices 208 on each container as the vehicle 212 and/or user device 208 passes each container. Depending on the indicator device(s) 208 that have been triggered on a given container, the interrogator electronics may receive responsive signals from some, all, or none of the transponders associated with a given container. Thereby, a control system associated with the interrogator electronics may be able to determine which indicator device(s) 208 on which containers were triggered, and thus may be able to obtain specific information about contaminants present in a given container. Those of skill in the art will appreciate that many other embodiments involving the use of RFID transponders and interrogators are contemplated and within the scope of the present invention.

Before, during, or after steps 306 through 312, the entity collecting refuse in the container may empty the contents of the container into the refuse collection vehicle 212. Alternatively, based on the results of the inspection at step 304, the entity collecting refuse may decline to collect the contents of the container based on the presence of contaminants in the waste stream. As noted above, whether the contents of the container were collected, and the reason(s) therefor, may be part of the waste stream information discussed herein.

At step 314, the previously transmitted waste stream information may be stored in a database. In various embodiments, the information may be transmitted to the database from refuse collection vehicle 212, user device 214, and/or a network 216 device as soon as it is received from an indicator assembly 200 coupled with a given container, or it may be transmitted periodically, such as at the end of a collection route, or on at some other time (e.g., weekly, monthly, etc.). In some embodiments, communications electronics 210 may send information regarding compliance/non-compliance directly to database 218 (via network 216) automatically upon actuation or operation of indicator devices 208 or on a periodic basis (even if not during a refuse collection route or on an assigned pickup day).

Regardless, the waste stream information is received and compiled at the database for use by MRFs, waste haulers, municipalities, and/or customers/waste generators. For instance, in some embodiments, a database maintained by an MRF may be used by the MRF to gather information regarding the types and volume of contamination in a waste stream, or the rates of change of contaminants in the waste stream over time. In other embodiments, a database maintained by a municipality may be used by the municipality to identify customers that repeatedly violate rules on waste stream contamination, to assess penalties for violations, and/or to identify customers that need further information regarding compliance. In still other embodiments, customers or waste generators may be given access the database. Thus, for example, customers may review their historical waste stream information, reasons a refuse container was not collected, rates of compliance or non-compliance, and the most typical contaminants introduced. Those of skill in the art will appreciate that a database of waste stream information may be used by MRFs, waste haulers, municipalities, and/or customers/waste generators in these and other ways to assess overall customer compliance and to lower contamination and costs.

At step 316, if all containers from which refuse is to be collected (e.g., those along a collection route) have not been processed, the method continues at step 304 with the next container. If all containers from which refuse is to be collected have been processed, then the method ends at step 318. Again, waste stream information may be transmitted to and/or stored in a database at this point, it may occur on a container-by-container basis, or it may occur at some later time.

Based on the foregoing, it will be appreciated that embodiments of the invention provide new and unique systems and methods for conveying and collecting information regarding contamination in a waste stream. Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

What is claimed is:

1. A refuse container comprising:

a container body comprising a receptacle portion and a lid rotatably coupled with the receptacle portion, the receptacle portion comprising a plurality of walls that together define an enclosed space for containing refuse; and at least one indicator device coupled with the container body, the at least one indicator device movable relative to the container body between a first position and a second position, wherein the at least one indicator device is movable in response to one or more of the following: actuation of a key and movement of a magnet; and first indicia provided on one of the at least one indicator device or the container body;

wherein when the at least one indicator device is in the first position, the first indicia are visible from the exterior of the refuse container, and wherein when the at least one indicator device is in the second position, the first indicia are not visible from the exterior of the refuse container.

2. The refuse container of claim 1, wherein the at least one indicator device is disposed within a housing integrally formed with the container body.

3. The refuse container of claim 2, wherein the at least one indicator device is coupled with the receptacle portion and the housing and receptacle portion are integrally formed together by rotational molding.

4. The refuse container of claim 1, wherein the at least one indicator device comprises a slidable panel.

5. The refuse container of claim 4, wherein the first indicia comprise a color applied to a bottom wall of the at least one indicator device.

6. The refuse container of claim 4, wherein the first indicia comprise textual information disposed on the container body.

7. The refuse container of claim 6, wherein the textual information is formed by hot stamping.

8. The refuse container of claim 1, wherein the at least one indicator device comprises a plurality of indicator devices.

9. A refuse container comprising:

a container body comprising a receptacle portion and a lid rotatably coupled with the receptacle portion, the receptacle portion comprising a plurality of walls and that together define an enclosed space for containing refuse; and at least one indicator assembly coupled with the container body, the at least one indicator assembly comprising at least one indicator device movably disposed within a housing from a first position to a second position, wherein the housing is disposed within the enclosed space;

wherein the at least one indicator assembly comprises first indicia that are visible from the exterior of the refuse container when the at least one indicator device is in the second position.

10. The refuse container of claim 9, wherein the container body defines a transparent portion through which the at least one indicator device is visible from the exterior of the refuse container.

11. The refuse container of claim 9, wherein the container body defines an aperture through which the at least one indicator device is visible from the exterior of the refuse container.

12. The refuse container of claim 9, wherein the housing is circular and the at least one indicator device comprises a rotatable panel.

13. A refuse container comprising:

a container body comprising a receptacle portion and a lid rotatably coupled with the receptacle portion, the receptacle portion comprising a plurality of walls that together define an enclosed space for containing refuse; and at least one indicator assembly coupled with the lid, the at least one indicator assembly comprising at least one indicator device movable relative to the lid between a first position and a second position, wherein the at least one indicator assembly comprises a button;

wherein first indicia are visible from the exterior of the refuse container when the at least one indicator device is in the second position.

14. The refuse container of claim 13, wherein the at least one indicator device is slidable within at least one slot defined in the lid.

15. A refuse container comprising:

a container body comprising a receptacle portion and a lid rotatably coupled with the receptacle portion, the receptacle portion comprising a plurality of walls that together define an enclosed space for containing refuse; and at least one indicator assembly coupled with the lid, the at least one indicator assembly comprising at least one indicator device movable relative to the lid between a first position and a second position, wherein the at least one indicator device comprises a clickable dial;

wherein first indicia are visible from the exterior of the refuse container when the at least one indicator device is in the second position.

16. A refuse container comprising:

a container body comprising a receptacle portion and a lid rotatably coupled with the receptacle portion, the receptacle portion comprising a plurality of walls that together define an enclosed space for containing refuse; and at least one indicator assembly coupled with the lid, the at least one indicator assembly comprising at least one indicator device movable relative to the lid between a first position and a second position, wherein the at least one indicator assembly comprises an electronic display;

wherein first indicia are visible from the exterior of the refuse container when the at least one indicator device is in the second position.

17. The refuse container of claim 13, wherein the at least one indicator assembly comprises a housing integrally formed with the lid.

* * * * *